US007228963B1

(12) United States Patent
Feibelman et al.

(10) Patent No.: US 7,228,963 B1
(45) Date of Patent: Jun. 12, 2007

(54) ANTI-THEFT DISPLAY BOX

(75) Inventors: Jeffrey A. Feibelman, Providence, RI (US); William A. McAuley, Slatersville, RI (US)

(73) Assignee: Display Technologies, Inc., Johnston, RI (US)

( * ) Notice: Subject to any disclaimer, the term of this patent is extended or adjusted under 35 U.S.C. 154(b) by 855 days.

(21) Appl. No.: 10/231,658

(22) Filed: Aug. 30, 2002

(51) Int. Cl.
*B65D 85/40* (2006.01)

(52) U.S. Cl. ..... 206/301; 206/1.5; 206/6.1

(58) Field of Classification Search ..... 206/301, 206/6.1, 1.5, 308.2, 566, 756, 760, 764, 776, 206/777, 779, 781, 782, 223
See application file for complete search history.

(56) References Cited

U.S. PATENT DOCUMENTS

| | | | | |
|---|---|---|---|---|
| 4,074,637 | A | 2/1978 | Lorenzen, Jr. | |
| 4,805,769 | A * | 2/1989 | Soltis et al. | 206/308.2 |
| 5,011,005 | A | 4/1991 | Boyd et al. | |
| 5,579,906 | A | 12/1996 | Fabbri et al. | |
| 5,601,188 | A | 2/1997 | Dressen et al. | |
| 5,762,187 | A | 6/1998 | Belden, Jr. et al. | |
| 5,873,457 | A | 2/1999 | Madweb | |
| 5,944,173 | A | 8/1999 | Boire et al. | |
| 6,199,309 | B1 | 3/2001 | Markarian | |
| 6,202,454 | B1 | 3/2001 | Nakasuji | |
| 6,308,539 | B1 | 10/2001 | Kolton et al. | |
| 6,352,606 | B1 | 3/2002 | DiMarco et al. | |
| 7,028,836 | B2 * | 4/2006 | Hsiao et al. | 206/308.2 |
| 7,032,750 | B2 * | 4/2006 | Amtenbrink | 206/379 |

* cited by examiner

*Primary Examiner*—Shian T. Luong
(74) *Attorney, Agent, or Firm*—BainwoodHuang

(57) ABSTRACT

An anti-theft box which displays an article in a manner which allows a consumer to handle the article without removing it from the box, and which deters theft of the article and/or box is disclosed. The anti-theft box includes a base for supporting the article, and a cover which engages and is lockable with the base. The article is visible through the cover, and an opening in the cover allows a consumer to touch the article without opening the cover or removing the article. In addition, the base includes a locking mechanism in order to normally lock the cover to the base so that it cannot be readily disengaged by the consumer. A retailer can readily engage the base, for example with a key plate, in order to easily open the cover. In one embodiment, an EAS marker is also supported within the base, preferably hidden from the consumer.

18 Claims, 9 Drawing Sheets

ANTI-THEFT DISPLAY BOX

DESCRIPTION

1. Technical Field

This invention relates generally to an anti-theft display box for protecting consumer articles from theft, and more particularly, to an improved anti-theft box for displaying an article in a manner which allows the article to be handled by a consumer while also reducing the likelihood of theft of the article and/or display box.

2. Background of Related Art

Surveillance systems which prevent or deter theft of merchandise from retail stores are well known in the art. For example, systems utilizing electronic article surveillance (EAS) markers or tags which activate an alarm upon removal of the article from the store are frequently utilized by retail stores. These types of markers are typically secured to an article and are either removed or rendered inactive at checkout. In some cases the markers are visible to consumers, and in other cases the markers are hidden from view in order to prevent unauthorized removal. In either case, if the markers are not rendered inactive or removed, they will be sensed by the EAS system causing an alarm to signal, usually when exiting the retail store. The use of such markers or tags to trigger an alarm have been somewhat successful in deterring the theft of merchandise. However, the use of such markers with certain types of merchandise has not always been successful due to the nature of the articles to be tagged. For example, some articles are inherently difficult to tag, either due to their size or ease of removal of the tag. In such cases, the EAS marker is often hidden in a holder displaying the article, for example by attaching the EAS marker to a display tag or hiding the marker in a display box. Although placing the marker in the holder displaying the article has also had limited success, a more reliable system for tagging expensive consumer articles, such as watches, is needed.

Because the most expensive component of a watch is the face which houses the watch mechanism, a person desiring to steal a watch will often simply remove the watch from its display box and cut the wristband as they pretend to try on the watch. Thus, the face of the watch is stolen, and any EAS marker contained on the wristband or in the box is discarded by the thief. In an attempt to deter the theft of watches, some retailers lock the watches behind display cases, and only remove the watches when a customer requests to see the watch. This requires the retailer to take out each watch individually and stay with the customer as he or she handles the watch, because upon removal from the locked case the watch becomes vulnerable to theft. This can become very burdensome as many consumers wish to handle a watch before purchasing it. Some watches are locked in plastic display boxes which, again, require the retailer to remove the watch from within the case in order for the consumer to handle the watch. In this case, the watch may not only be stolen upon removal, but the box itself may be stolen with the watch in it.

In view of the foregoing, it will be appreciated that while utilizing EAS markers has met with some success, the success has been limited for certain consumer articles, for example watches, eyeglasses and other jewelry items. Therefore, there is a continued need in the art for a an improved anti-theft device for watches, and the like, which can display an article to a consumer, allow the consumer to handle the article in some manner, while also deterring the theft of the article.

SUMMARY

It is an object of the anti-theft box disclosed herein to provide a device which can be used to display a consumer article, allow a consumer to handle the article in some manner without removing it from the box, while also deterring theft of the article and/or box. The anti-theft display box preferably includes a base for supporting the article to be displayed, and a cover which engages and is lockable with the base. The article is visible through the cover, and an opening in the cover allows a consumer to touch the article without opening the locked cover or removing the article. The article is preferably supported on the base so that it can be touched through the cover, but not removed through the opening. In addition, the base includes a locking mechanism in order to normally lock the cover to the base so that it cannot be readily disengaged by the consumer. However, upon bringing the box to a retail associate for purchase, the associate can readily engage the base, for example with a key plate, in order to easily open the cover. In one embodiment, an EAS marker is also supported within the base, preferably hidden from the consumer. A flashing light may also be visible to alert the consumer to the existence of a security feature, in an attempt to further deter theft of the article.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
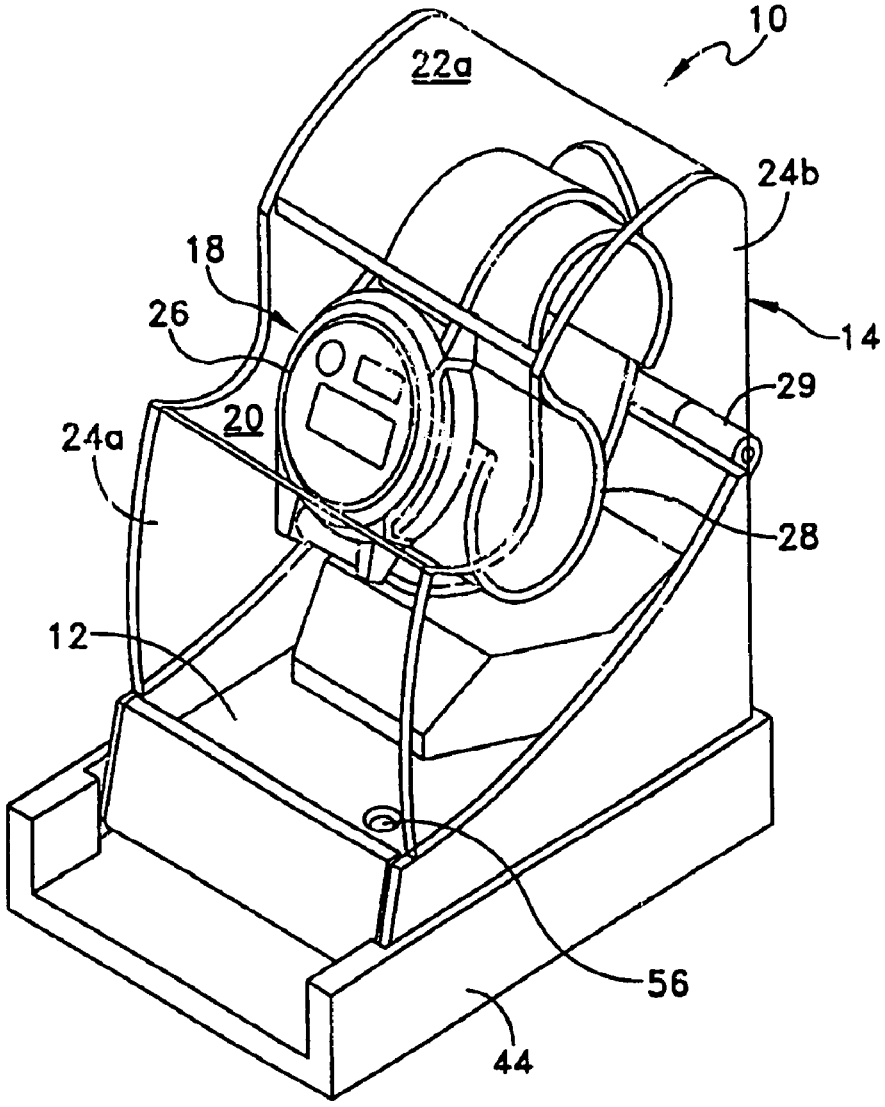
FIG. 1 is a perspective view of an anti-theft display box adapted to hold a time piece according to one embodiment.
Figure 2:
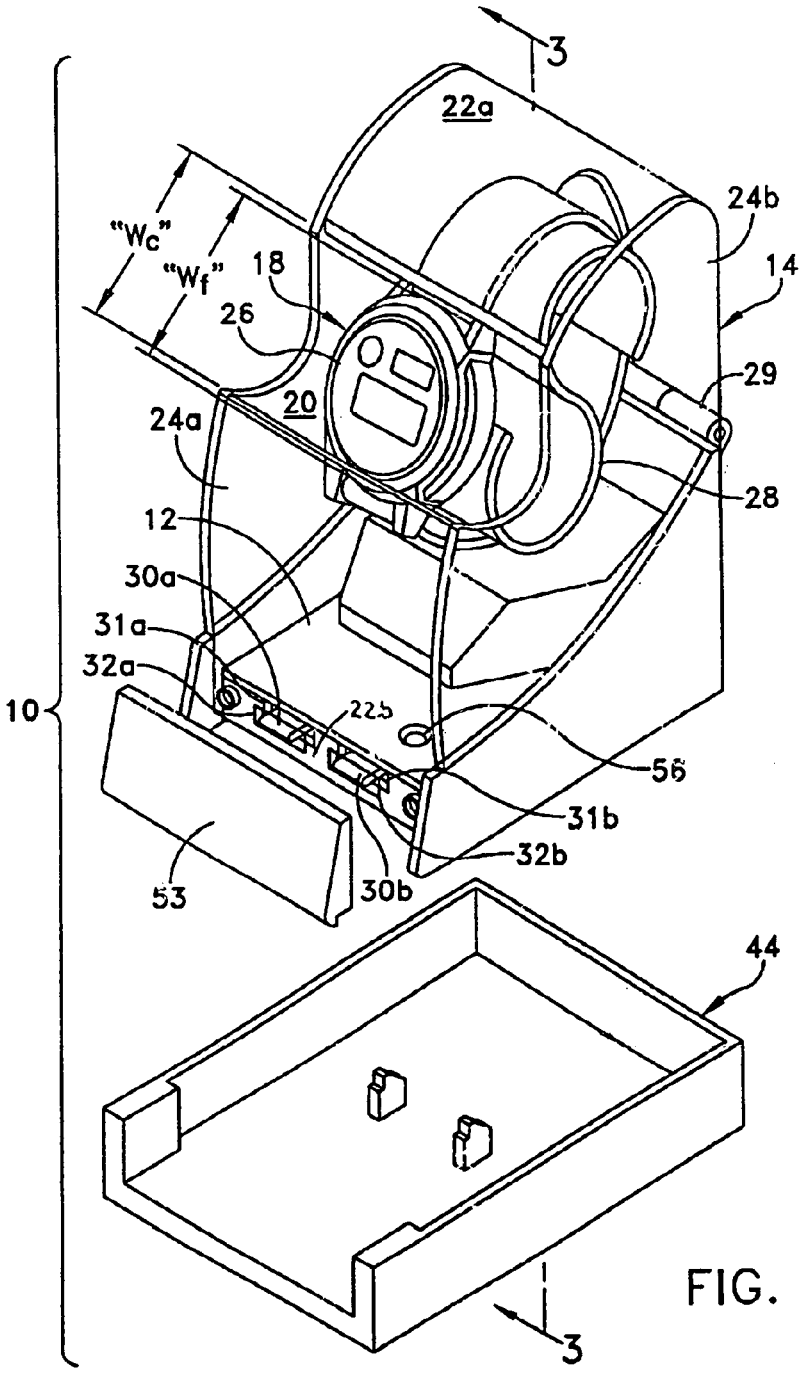
FIG. 2 is an exploded perspective view of the embodiment of FIG. 1, showing the display box removed from a key release plate.

Referring now to FIGS. 1–8, an anti-theft display box 10 designed to display a consumer article, while deterring theft of the article, is illustrated. The box 10 preferably includes a base 12 which supports the article, and a cover 14 through which the article may be viewed. As used herein, the term "article" refers to any article which may be displayed to a consumer. Although a watch is the illustrative article described herein, it will be understood that the invention is not limited to watches, but may find application with other consumer articles as well. As best shown in FIGS. 3–8, the base 12 of display box 10 supports a locking mechanism 16 which locks the cover 14 to the base 12 when the cover is closed, such that the cover may not be opened without disengaging the locking mechanism.

The cover 14 is preferably fabricated of a transparent material so that watch 18 can be readily viewed through the cover. The cover also includes an opening 20 which may preferably be formed in a top portion 22*a* of the cover, and which may extend between the side walls 24*a*, 24*b* of the cover. The opening 20 is preferably positioned so that a consumer can reach in and touch the article contained within the box 10. In the present embodiment, for example, the opening 20 may be aligned with the watch face 26, such that the user can touch and possibly operate the functions disposed on the face of the watch, without removing the watch from within the case. In order to deter removal of the watch 18 from within the case 10 through the opening 20, the watch is preferably secured to a mounting member 28 supported on base 12. The mounting member is known in the art, and also serves the function of displaying the watch in a visually appealing manner. In the present embodiment, the watch is secured to the mounting member at a location spaced from the opening 20, and which cannot be readily reached through the opening to further deter theft. In addition, the opening 20 may preferably have a size and/or shape which, while allowing a consumer to touch the article contained in the box, discourages removal of the article through the opening. For example, in the present embodiment the opening may have a width "$w_c$", which is lesser than the width "$w_f$" of the watch face 26. As will be appreciated, by securing the watch within the display box 10 in the aforementioned manner, the watch may be handled or touched in some way by the consumer, without being removed from the box, and without the box being opened.

The cover of the display box 10 may preferably be pivotably attached to the base 12, for example by hinge 29, to facilitate removing and mounting the watch or other article within the box. Alternately, the cover may be removable from the base, or otherwise attached in a manner as would be known to one of skill in the art. In the present embodiment, the cover is movable between the open position (FIG. 4), where the cover is not in locking engagement with the base, and a closed position (FIG. 3) in which the cover matingly engages the base in order to lock the cover to the base thus preventing unauthorized opening of the cover and removal of the watch. As shown in the Figures, the locking mechanism 16 may be housed within the base 12 and preferably normally maintains the cover in the locked position.

Figure 3:
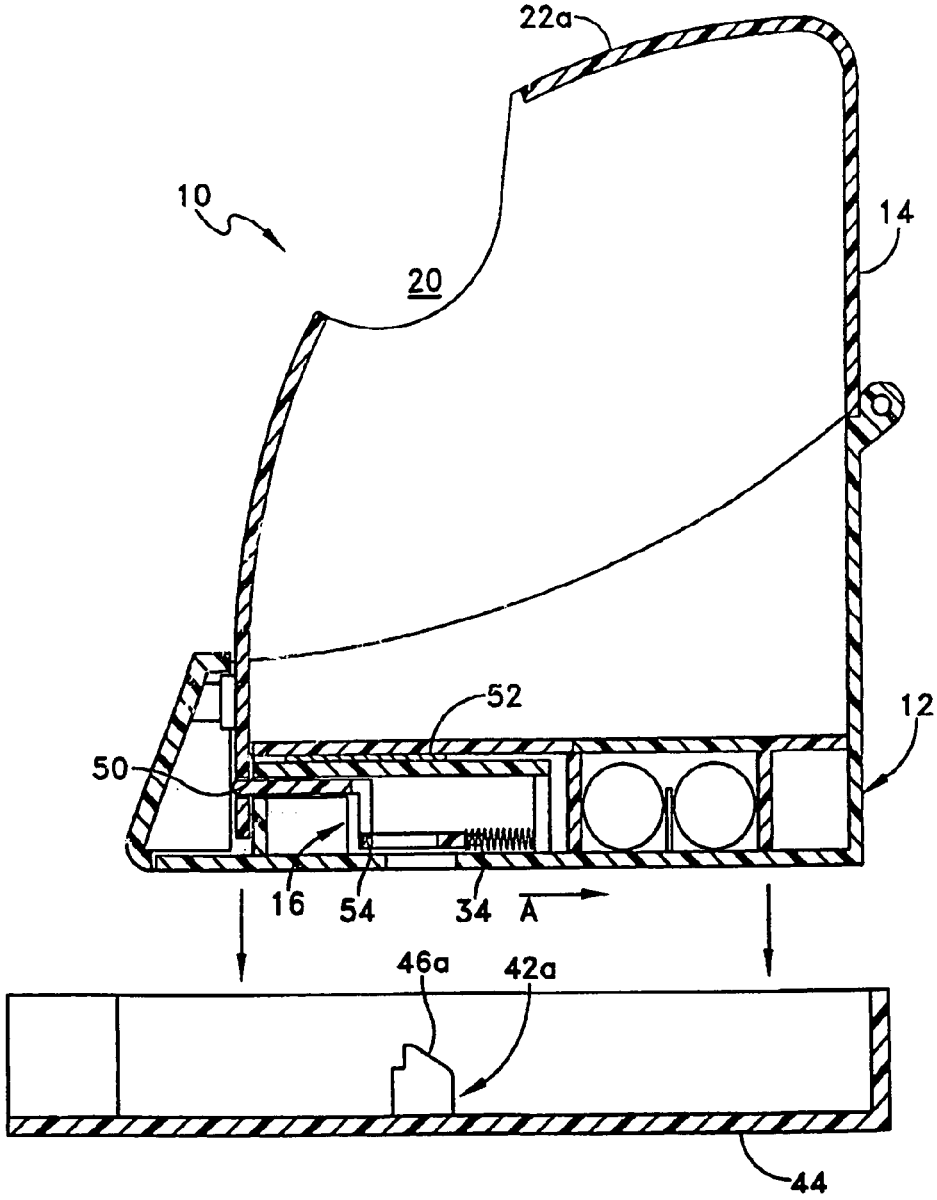
FIG. 3 is a cross-sectional view of the embodiment of FIG. 2 taken along lines 3—3.
Figure 4:
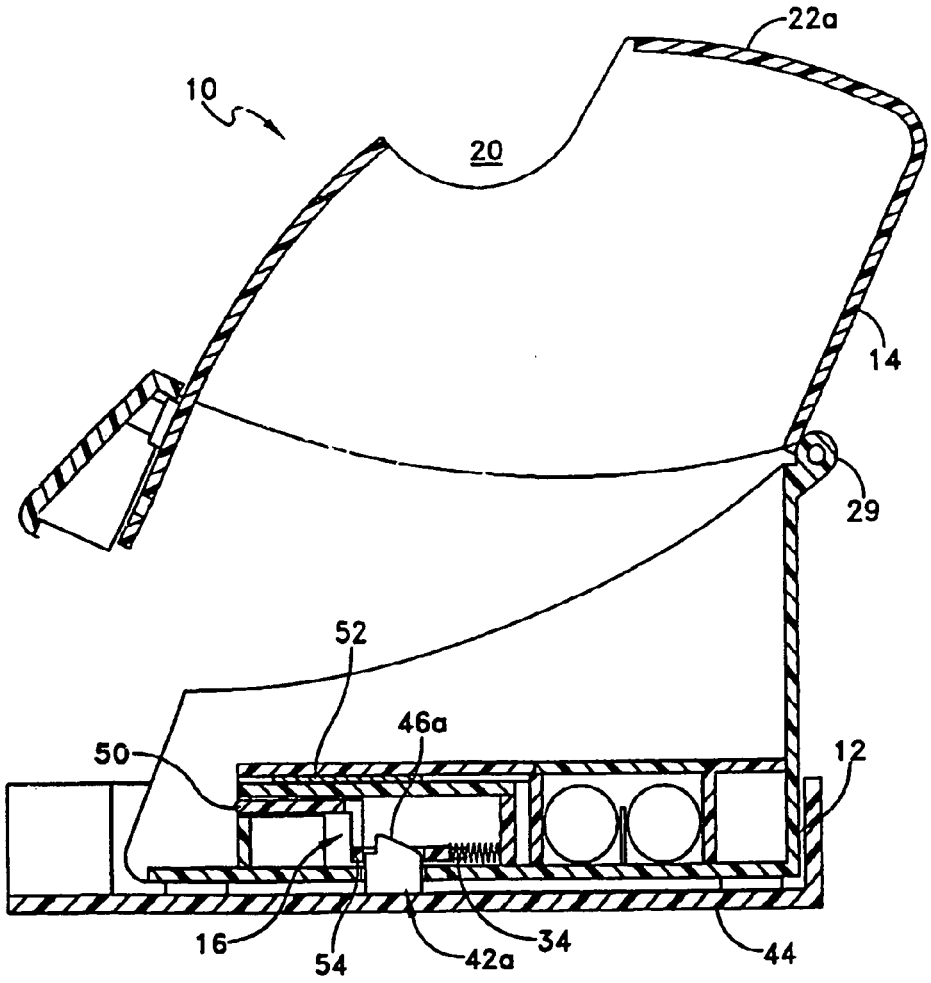
FIG. 4 is a cross-sectional view of the embodiment of FIG. 1 in an open or non-secured position.
Figure 5:
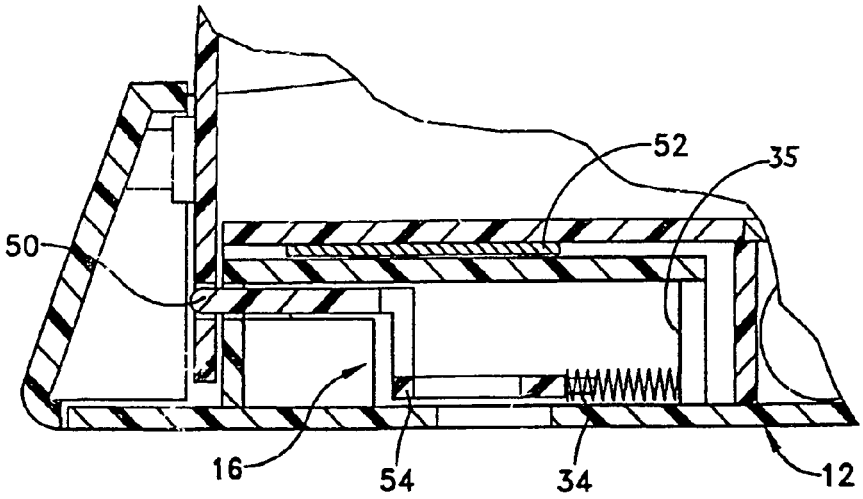
FIG. 5 is an enlarged cross-sectional view of the bottom of the anti-theft box and key release plate of FIG. 1 in the locked or engaged position.
Figure 6:
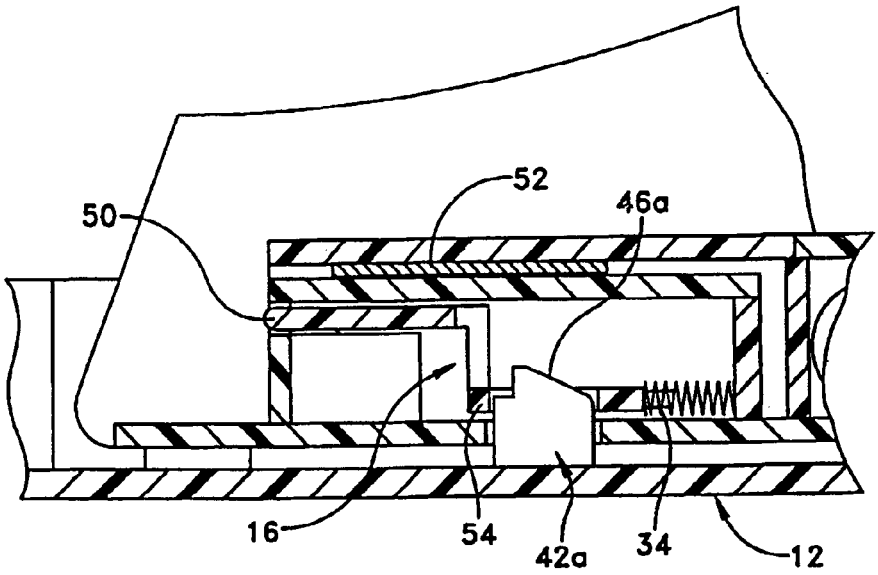
FIG. 6 is an enlarged cross-sectional view of the key release plate and bottom of the anti-theft box of FIG. 4.
Figure 7:
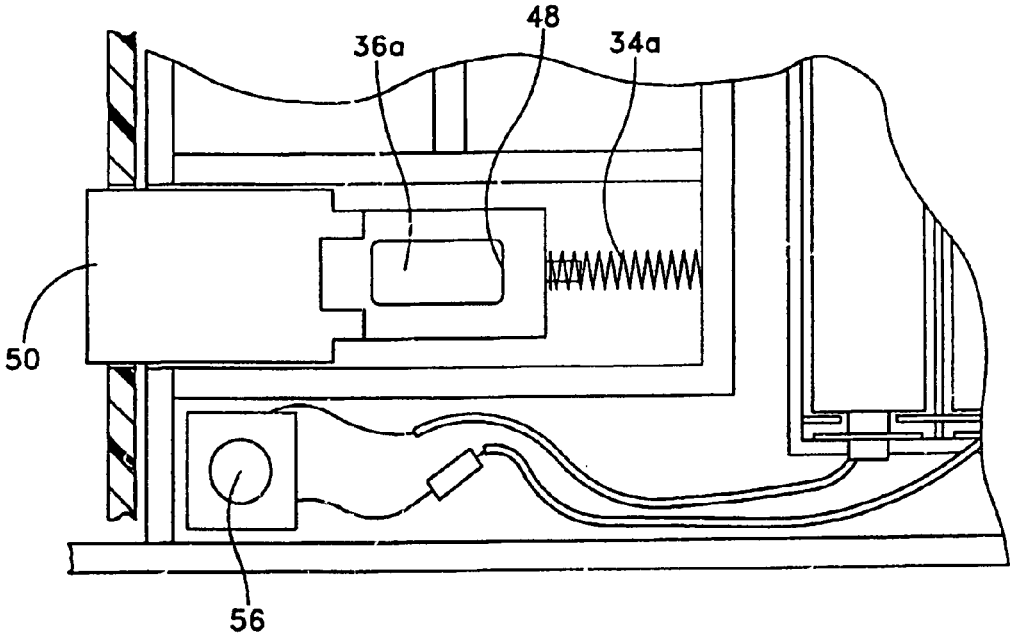
FIG. 7 is a top plan view of the lock mechanism of the anti-theft box of FIG. 1 in a locked position.
Figure 8:
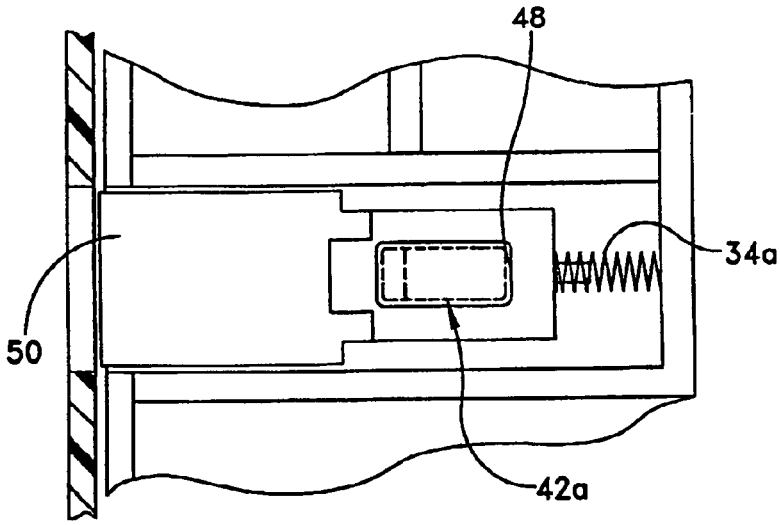
FIG. 8 is a top plan view of the lock mechanism of the anti-theft box of FIG. 1 in an unlocked position.
Figure 9:
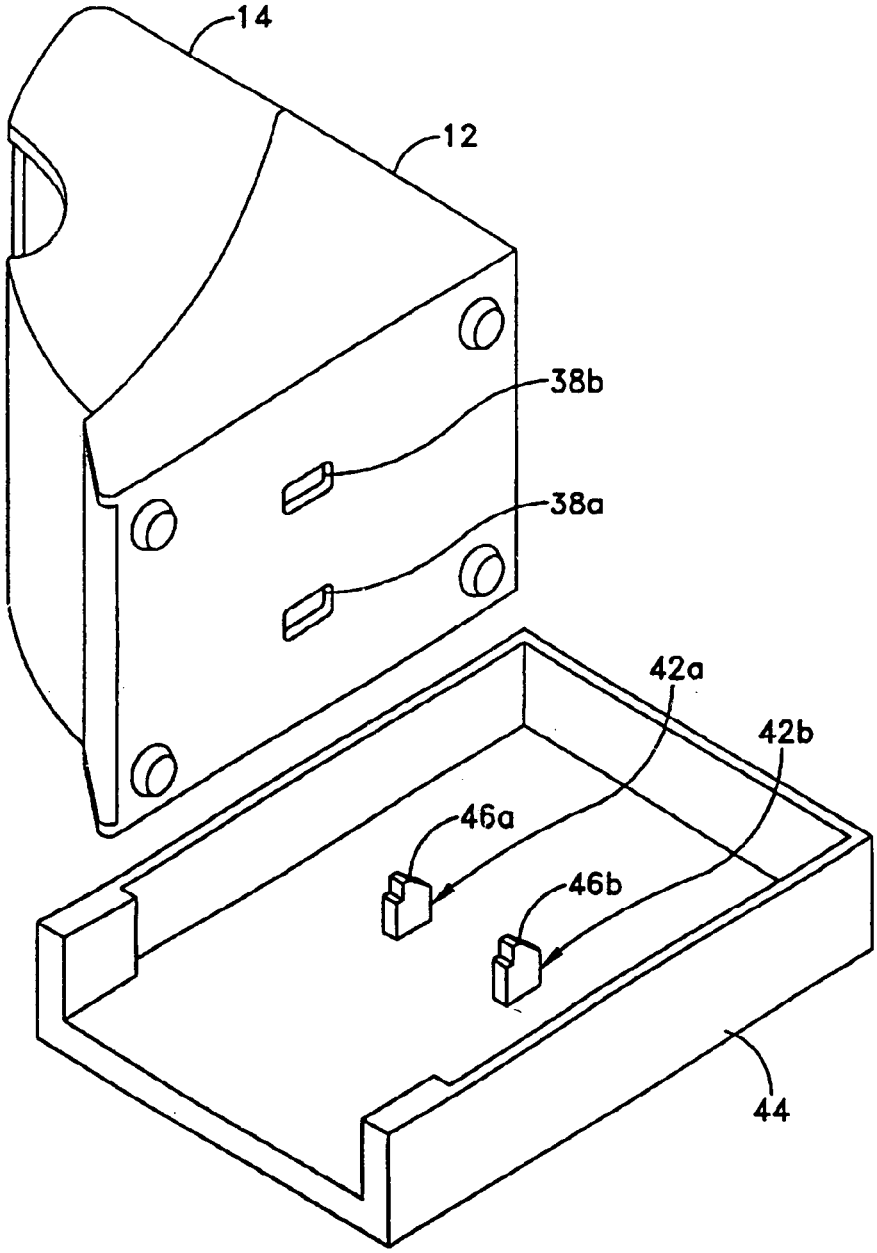
FIG. 9 is a perspective view showing the bottom of the anti-theft box.

Referring now to FIGS. 2–9, in the present embodiment the locking mechanism 16 may preferably include a pair of tabs 30*a*, 30*b* which extend through a pair of slots 31*a*, 31*b* disposed through a front face of base 12, and into corresponding slots 32*a*, 32*b* disposed in a bottom portion 22*b* of the cover 14 during use. The tabs 30*a*, 30*b* are preferably spring biased such that as the cover engages the tabs as it is closed, the tabs are moved rearwardly in the direction of arrow "A" (FIG. 3), and thereafter extend into the slots 32*a*, 32*b* of the cover upon alignment with the slots 31*a*, 31*b* to normally maintain the cover locked to the base in the closed position. Each tab 30*a*, 30*b* may preferably be supported within the base, and may have a generally "z" shaped configuration, with an upper portion 50 of the "z" extending into the slots (31*a*, 31*b* and 32*a*, 32*b*), and a lower portion 54 engaging a first end of a biasing spring 34. As illustrated, the second end of the biasing spring 34 engages wall 35 to normally bias the tabs into the outward or extended position, as shown in FIGS. 3, 5, and 7. When the tabs are moved in the direction of arrow A, either because the cover is being closed, or because the box is being unlocked, the force of the springs 34*a*, 34*b* is overcome thus allowing the tabs to move inwardly.

In the present embodiment, the tabs may each further include an opening 36*a*, 36*b* (not shown) disposed in the lower portion 54 of each tab. The tab openings 36*a*, 36*b* are positioned in substantial alignment with a pair of openings 38*a*, 38*b* formed in the bottom 40 of the base 12. In order to unlock the box, and remove the watch supported therein, a pair of protrusions 42*a*, 42*b* are preferably supported on a key plate 44, and are inserted within the openings 38*a*, 38*b* in the base and through openings 36*a*, 36*b* in the tabs by the retailer to unlock the box. The protrusion preferably each include an inclined surface 46*a*, 46*b* such that as they are being inserted within the openings of the tab, they engage an interior back wall 48 of the tabs in order to move the tabs inwardly, in the direction of arrow "A", against the biasing force of spring 34. This causes the upper portion 50 of the tabs, which protrude from within the slots 32*a*, 32*b* in the cover 14, to retract from within the cover slots, thus unlocking the cover from the base. Although a pair of tabs are shown and described, the locking mechanism may include a single tab and spring. Alternatively, the locking mechanism may have any of a variety of configurations, and the tab, if utilized, may take any of a number of shapes.

The base 12 may further include an EAS marker 52 supported within an interior portion of the base so that it is not visible to the consumer. In the present embodiment, the EAS marker may be disposed between a cover which covers the cavity that houses the locking mechanism, and an interior surface of the support of the base. A front plate 53 may also be provided in order to conceal the tabs 30*a*, 30*b*. In addition, a flashing light 56 may also be visible to alert the consumer to the existence of a security feature, in an attempt to further deter theft of the article without allowing the consumer to know the type of security feature.

Use of the anti-theft box of the first embodiment will now be described with reference to FIGS. 1–9. In use, the cover and base are in an open position, and the article is placed within the base of the box on a mounting member in any of a variety of known manners. The cover is then moved from the open position (FIG. 4) to the closed position (FIG. 3). Upon rotating the cover into the closed position, the bottom portion of the cover contacts the locking tabs which normally extend through the slots in the base member. As the cover contacts the locking tabs they are initially forced inwardly against the biasing force of the locking spring. As the cover continues to move into the closed position, the slots in the bottom portion of the cover eventually align with the slots in the base. When they are aligned, the force exerted by the cover is released and the locking tabs are extended into the slots in the cover by the locking spring. In this position the cover is locked to the base. The consumer may then pick up the box and touch the article by reaching through the opening in the cover. If the consumer attempts to remove the box from the store, an alarm will sound, if an EAS marker has been positioned within the box. To unlock the cover, the key plate is utilized by the retailer. The retailer inserts the inclined protrusions into opening formed in the bottom of the base, and into corresponding openings formed in the locking tabs. This forces the locking tabs to move inwardly, against the bias of the spring, as described above. As the locking tabs move inwardly, they are removed from engagement with the slots on the cover, and the cover is thereby unlocked from engagement with the base.

Figure 10:
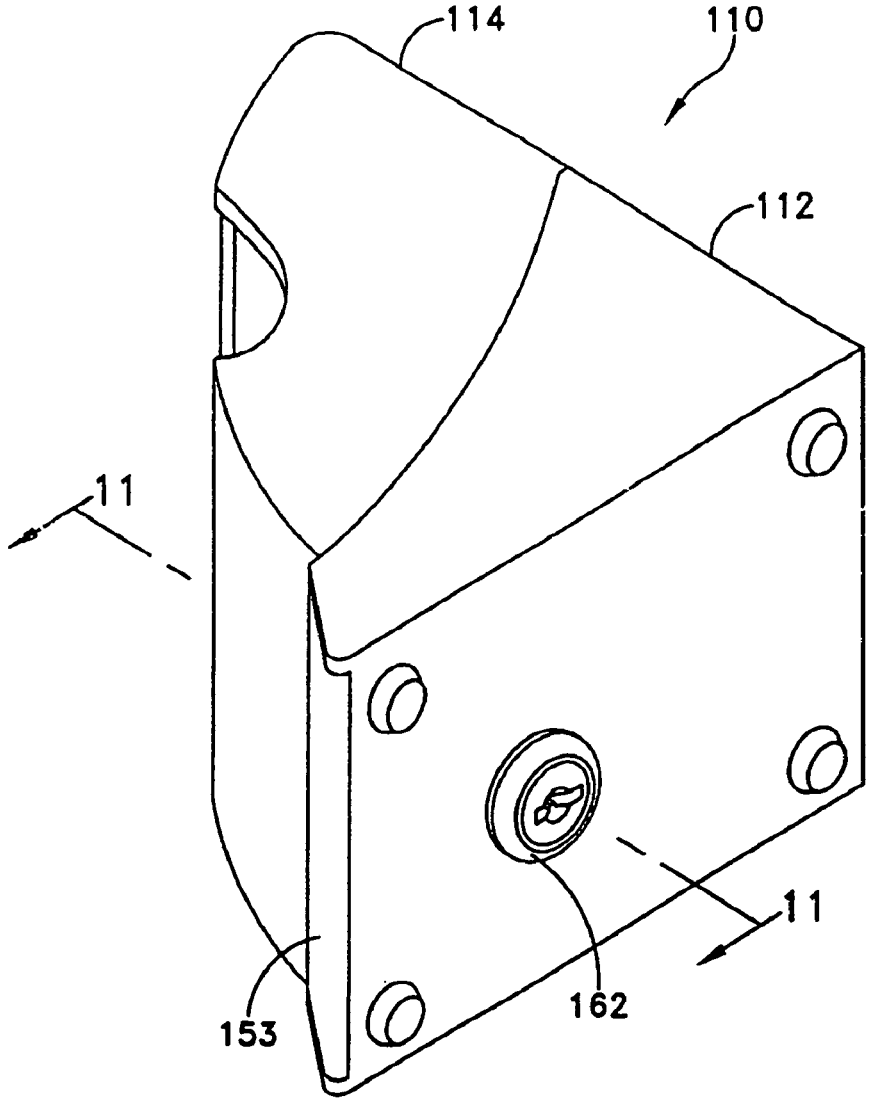
FIG. 10 is a perspective view of a second embodiment of the anti-theft lock box having a key lock mechanism.
Figure 11:
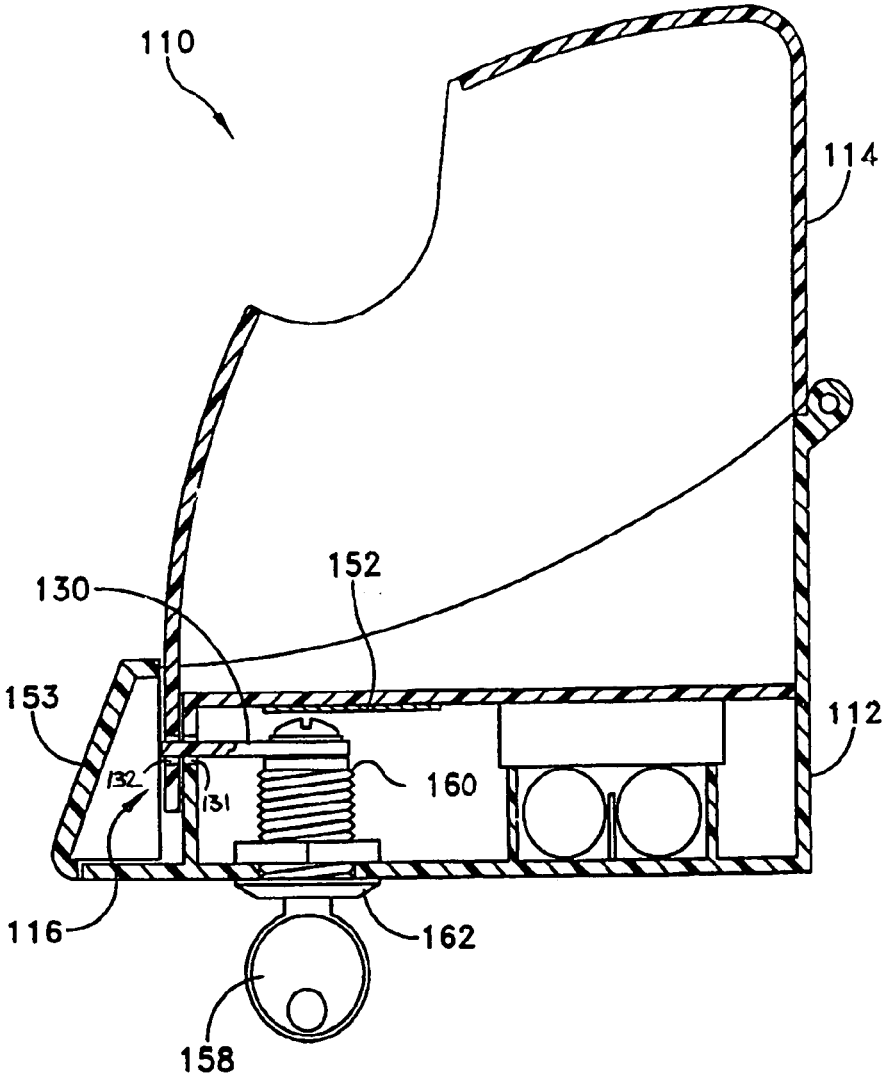
FIG. 11 is a cross-sectional view of the embodiment of FIG. 9 taken along lines 10—10.

Referring now to FIGS. 10–11, second embodiment of the anti-theft box is illustrated. In this embodiment, all parts which are the same, or similar to, corresponding parts of the first embodiment are noted with the same two last numbers, but preceded by the numeral "1". The anti-theft box 110 is identical to box 10 in most respects, the differences in the box 110 being the locking mechanism 116, which is operated by a key 158 instead of a key plate. As best shown in FIG. 11, the locking mechanism 116 includes a tab 130 which engages a slot 131 disposed through a front face of base 112, and into corresponding slot 132 disposed in a bottom portion of the cover 114 during use. In the present embodiment, the tab 130 is supported for rotation on a post 160 which is rotated by insertion of key 158 into lock 162. In use, after the key 158 is inserted into lock 162 it is rotated by the user, which causes corresponding rotation of post 160 and tab 130. As the tab 130 is rotated it disengages from the slots 131, 132, allowing the cover 114 to be opened. All other aspects of anti-theft box 110 are the same as described herein above with respect to FIGS. 1–9.

It will be understood that various modifications may be made to the embodiment disclosed herein. For example, the size and shape of the opening in the cover may be readily varied, a variety of locking mechanisms may be utilized which may or may not be supported in the base, and alternate mounting members may also be utilized to support and display the article, as would be known to one of skill in the art. Therefore, the above description should not be construed as limiting, but merely as exemplifications of a preferred embodiment. Those skilled in the art will envision other modifications within the scope, spirit and intent of the invention.

What is claimed is:

1. An anti-theft box for displaying an article comprising:

a cover including a first opening disposed through a top portion of the cover, and having at least one slot;

a base constructed and arranged to support the article, the base including at least one slot substantially aligned with the at least one slot of the cover in a closed position;

a locking mechanism supported within the base and including at least one tab, the locking mechanism being constructed and arranged to engage the cover upon closing the cover such that the at least one tab extends from within the at least one slot of the base and engages the at least one slot of the cover; and wherein the first opening in the cover is aligned with the article in the closed position, such that the article may be touched by a consumer through the opening, and wherein the locking mechanism engages the cover upon moving the cover from an open position to the closed position in order to lock the box.

2. The anti-theft box of claim 1, wherein the locking mechanism further includes a spring constructed and arranged to bias the at least one tab into the slot of the cover in the closed position.

3. The anti-theft box of claim 2, wherein the at least one tab includes an opening, and the base includes at least one corresponding opening, the opening of the tab and the opening of the base being substantially aligned.

4. The anti-theft box of claim 3, further comprising a key plate having at least one protrusion constructed and arranged to engage the opening of the at least one tab through the opening of the base.

5. The anti-theft box of claim 4, wherein the at least one protrusion includes an inclined surface constructed and arranged to engage a wall of the at least one tab so as to move the at least one tab from within the at least one slot in the cover and into the base, against the force of the spring, so as to unlock the cover from the base.

6. The anti-theft box of claim 1, wherein the cover includes a pair of side walls, and the opening extends between the pair of side walls.

7. The anti-theft box of claim 1, further including an electronic article surveillance marker supported within the base.

8. The anti-theft box of claim 1, wherein the cover is rotatably supported on the base.

9. An anti-theft box for displaying an article comprising:

a base constructed and arranged to support the article;

a cover including a first opening disposed through a top portion of the cover;

a locking mechanism supported within the base and constructed and arranged to engage the cover upon closing the cover;

a light supported on the base and visible through the cover; and wherein the first opening in the cover is aligned with the article in a closed position, such that the article may be touched by a consumer through the opening, and wherein the locking mechanism engages the cover upon moving the cover from an open position to the closed position in order to lock the box.

10. An anti-theft box for displaying an article comprising:

a mounting member constructed and arranged to support the article;

a cover including a first opening disposed through a top portion of the cover, and having at least one slot;

a base constructed and arranged to support the article, the base including at least one slot substantially aligned with the at least one slot of the cover in a closed position;

a locking mechanism supported within the base and including at least one tab, the locking mechanism being constructed and arranged to engage the cover upon closing the cover such that the at least one tab extends from within the at least one slot of the base and engages the at least one slot of the cover;

an electronic article surveillance marker supported within the box; and wherein the first opening in the cover is aligned with the article in the closed position; such that the article may be touched by a consumer through the opening, and wherein the locking mechanism engages the cover upon moving the cover from an open position to the closed position in order to lock the box.

11. The anti-theft box of claim 10, wherein the locking mechanism further includes a spring constructed and arranged to bias the at least one tab into the slot of the cover in the closed position.

12. The anti-theft box of claim 11, wherein the at least one tab includes an opening, and the base includes at least one corresponding opening, the opening of the tab and the opening of the base being substantially aligned.

13. The anti-theft box of claim 12, further comprising a key plate having at least one protrusion constructed and arranged to engage the opening of the at least one tab through the opening of the base.

14. The anti-theft box of claim 13, wherein the at least one protrusion includes an inclined surface constructed and arranged to engage a wall of the at least one tab so as to move the at least one tab from within the at least one slot in the cover and into the base, against the force of the spring, so as to unlock the cover from the base.

15. The anti-theft box of claim 10, wherein the cover includes a pair of side walls, and the opening extends between the pair of side walls.

16. The anti-theft box of claim 10, wherein the cover is rotatably supported on the base.

17. The anti-theft box of claim 10, further comprising a light supported on the base and visible through the cover.

18. The anti-theft box of claim 10, wherein the locking mechanism further includes a key and a lock, and wherein the at least one tab is rotatably supported on a post, the post being rotated by operation of the key within the lock.

* * * * *